US012342868B2

(12) United States Patent
Warren et al.

(10) Patent No.: US 12,342,868 B2
(45) Date of Patent: Jul. 1, 2025

(54) AEROSOL PROVISION DEVICE

(71) Applicant: Nicoventures Trading Limited, London (GB)

(72) Inventors: Luke Warren, London (GB); Walid Abi Aoun, London (GB); Jeremy Campbell, London (GB); Barry Dimmick, London (GB); William England, London (GB); Conor John McGrath, London (GB); Barnaby Oakley, London (GB); Michael Thomas, London (GB); Jack Quarmby, London (GB); Charles Leoni, London (GB)

(73) Assignee: NICOVENTURES TRADING LIMITED, London (GB)

( * ) Notice: Subject to any disclaimer, the term of this patent is extended or adjusted under 35 U.S.C. 154(b) by 561 days.

(21) Appl. No.: 17/437,886

(22) PCT Filed: Jun. 5, 2020

(86) PCT No.: PCT/EP2020/065736
§ 371 (c)(1),
(2) Date: Sep. 10, 2021

(87) PCT Pub. No.: WO2020/249491
PCT Pub. Date: Dec. 17, 2020

(65) Prior Publication Data

US 2022/0167677 A1 Jun. 2, 2022

(30) Foreign Application Priority Data

Jun. 10, 2019 (WO) ..... PCT/CN2019/090589

(51) Int. Cl.
*A24F 40/465* (2020.01)
*A24F 40/48* (2020.01)
*A24F 40/85* (2020.01)

(52) U.S. Cl.
CPC ..... *A24F 40/465* (2020.01); *A24F 40/48* (2020.01); *A24F 40/85* (2020.01)

(58) Field of Classification Search
CPC ..... A24F 40/465; A24F 40/85; A24F 40/48
(Continued)

(56) References Cited

U.S. PATENT DOCUMENTS 5,954,979 A 9/1999 Counts et al.
8,833,364 B2 9/2014 Buchberger
(Continued)

FOREIGN PATENT DOCUMENTS

AU 2017263072 A1 11/2018
CN 205597123 U 9/2016
(Continued)

OTHER PUBLICATIONS

International Search Report and Written Opinion for International Application No. PCT/EP2020/065736 mailed on Oct. 2, 2020, 11 pages.
(Continued)

*Primary Examiner* — Gary F Paumen
(74) *Attorney, Agent, or Firm* — Husch Blackwell

(57) ABSTRACT

An aerosol provision device including a housing delimiting a first opening at a first end of the housing through which to receive aerosol generating material and a second opening at a second end of the housing, wherein at least one heater is arranged within the housing and configured to heat the aerosol generating material received within the housing thereby to generate an aerosol, and wherein a hollow member is arranged within the housing and extends at least
(Continued)

partially between the second and first openings, the hollow member having an end that faces the second opening and is configured to encourage the formation of liquid droplets.

19 Claims, 13 Drawing Sheets

(58) Field of Classification Search
USPC ..... 131/329
See application file for complete search history.

(56) References Cited

U.S. PATENT DOCUMENTS

| | | | | |
|---|---|---|---|---|
| 9,814,269 | B2 * | 11/2017 | Li | H05B 3/44 |
| 10,039,318 | B2 | 8/2018 | Daryani | |
| 11,235,109 | B2 * | 2/2022 | Thorsen | A61M 11/042 |
| 2005/0274744 | A1 | 12/2005 | Spada et al. | |
| 2018/0098571 | A1 | 4/2018 | Watson | |
| 2018/0279688 | A1 | 10/2018 | Qiu | |
| 2018/0310623 | A1 * | 11/2018 | Batista | A24F 7/00 |

FOREIGN PATENT DOCUMENTS

| | | | |
|---|---|---|---|
| CN | 207236096 | U | 4/2018 |
| CN | 207639682 | U | 7/2018 |
| CN | 109195463 | A | 1/2019 |
| CN | 208434722 | U | 1/2019 |
| CN | 208676375 | U | 4/2019 |
| EA | 026076 | B1 | 2/2017 |
| EP | 3020292 | A1 | 5/2016 |
| EP | 3289894 | A1 | 3/2018 |
| EP | 3 490 394 | A1 | 6/2019 |
| EP | 3490394 | | 6/2019 |
| JP | 2016078911 | A | 5/2016 |
| JP | 2016176993 | A | 10/2016 |
| JP | 2017063950 | A | 4/2017 |
| RU | 2672657 | C2 | 11/2018 |
| WO | WO-2015173105 | A1 | 11/2015 |
| WO | WO 2017/068101 | A1 | 4/2017 |
| WO | 2017194762 | A1 | 11/2017 |
| WO | WO-2018019786 | A1 | 2/2018 |
| WO | WO-2019036853 | A1 | 2/2019 |
| WO | WO-2019081906 | A1 | 5/2019 |

OTHER PUBLICATIONS

International Search Report and Written Opinion for International Application No. PCT/EP 2020/065736, dated Sep. 16, 2020, 11 pages.

"International Preliminary Report on Patentability received for PCT Patent Application No. PCT/EP2020/065736, mailed on Dec. 23, 2021", 8 pages.

"International Search Report and Written Opinion received for PCT Patent Application No. PCT/CN2019/090589, mailed on Mar. 10, 2020", 10 pages.

"Office Action received for Russian Patent Application No. 2021136070, mailed on Aug. 2, 2022".

* cited by examiner

AEROSOL PROVISION DEVICE

RELATED APPLICATION INFORMATION

The present application is a National Phase entry of PCT Application No. PCT/EP2020/065736, filed Jun. 5, 2020, which claims priority from PCT Application No. PCT/CN2019/090589, filed Jun. 10, 2019, each of which is hereby fully incorporated herein by reference.

TECHNICAL FIELD

The present invention relates to an aerosol provision device.

BACKGROUND

Smoking articles such as cigarettes, cigars and the like burn tobacco during use to create tobacco smoke. Attempts have been made to provide alternatives to these articles that burn tobacco by creating products that release compounds without burning. Examples of such products are heating devices which release compounds by heating, but not burning, the material. The material may be for example tobacco or other non-tobacco products, which may or may not contain nicotine.

SUMMARY

According to a first aspect of the present disclosure, there is provided an aerosol provision device, comprising: a housing delimiting a first opening at a first end of the housing through which to receive aerosol generating material and delimiting a second opening at a second end of the housing; and at least one heater arranged within the housing and configured to heat the aerosol generating material received within the housing thereby to generate an aerosol; and a hollow member arranged within the housing and extending at least partially between the second and first openings, wherein: the hollow member has an end that faces the second opening and is configured to discourage capillary flow around the end.

According to a second aspect of the present disclosure, there is provided an aerosol provision device, comprising: a housing delimiting a first opening at a first end of the housing through which to receive aerosol generating material and delimiting a second opening at a second end of the housing; and at least one inductive heater arranged within the housing and configured to heat the aerosol generating material received within the housing thereby to generate an aerosol; and a hollow member arranged within the housing and extending at least partially between the second and first openings, wherein: the hollow member has: a first end in the direction towards the first opening and a second end in the direction towards the second opening; an inner diameter that reduces towards the second end; and a minimum inner diameter positioned less than about 50% of the distance from the second end to the first end.

According to a third aspect of the present disclosure, there is provided an aerosol w provision device, comprising: a housing delimiting a first opening at a first end of the housing through which to receive aerosol generating material and delimiting a second opening at a second end of the housing; and at least one heater arranged within the housing and configured to heat the aerosol generating material received within the housing thereby to generate an aerosol; and a hollow member arranged within the housing and extending at least partially between the second and first openings, wherein: the hollow member has an inner surface comprising one or more ridges or grooves configured to impede any liquid flow along the inner surface towards the second opening.

Further features and advantages of the invention will become apparent from the following description of preferred embodiments of the invention, given by way of example only, which is made with reference to the accompanying drawings.

DETAILED DESCRIPTION

Figure 1:
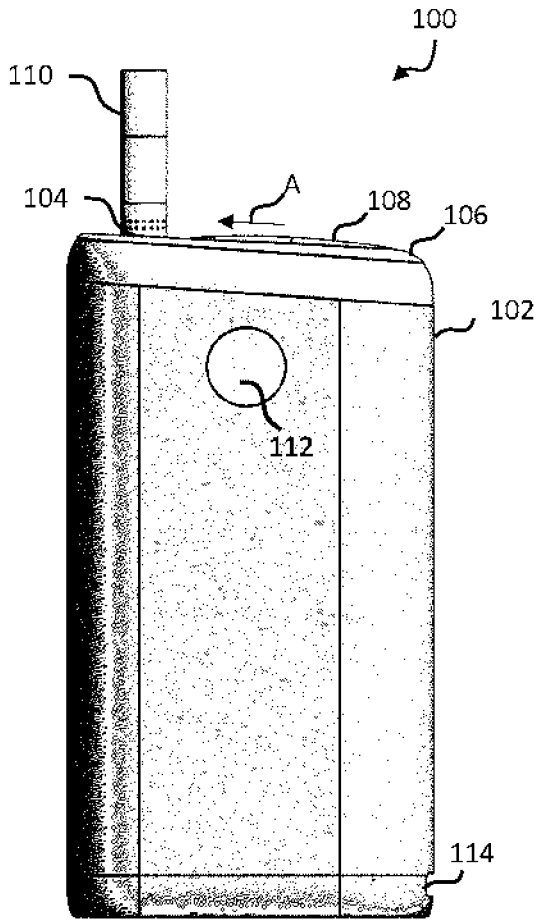
FIG. 1 shows a front view of an example of an aerosol provision device.

As used herein, the term "aerosol generating material" includes materials that provide volatilised components upon heating, typically in the form of an aerosol. Aerosol generating material includes any tobacco-containing material and may, for example, include one or more of tobacco, tobacco derivatives, expanded tobacco, reconstituted tobacco or tobacco substitutes. Aerosol generating material also may include other, non-tobacco, products, which, depending on the product, may or may not contain nicotine. Aerosol generating material may for example be in the form of a solid, a liquid, a gel, a wax or the like. Aerosol generating material may for example also be a combination or a blend of materials. Aerosol generating material may also be known as "smokable material".

Apparatus is known that heats aerosol generating material to volatilise at least one component of the aerosol generating material, typically to form an aerosol which can be inhaled, without burning or combusting the aerosol generating material. Such apparatus is sometimes described as an "aerosol generating device", an "aerosol provision device", a "heat-not-burn device", a "tobacco heating product device" or a "tobacco heating device" or similar. Similarly, there are also so-called e-cigarette devices, which typically vaporise an aerosol generating material in the form of a liquid, which may or may not contain nicotine. The aerosol generating material may be in the form of or be provided as part of a rod, cartridge or cassette or the like which can be inserted into the apparatus. A heater for heating and volatilising the aerosol generating material may be provided as a "permanent" part of the apparatus.

An aerosol provision device can receive an article comprising aerosol generating material for heating. An "article" in this context is a component that includes or contains in use the aerosol generating material, which is heated to volatilise the aerosol generating material, and optionally other components in use. A user may insert the article into the aerosol provision device before it is heated to produce an aerosol, which the user subsequently inhales. The article may be, for example, of a predetermined or specific size that is configured to be placed within a heating chamber of the device which is sized to receive the article.

A first aspect of the present disclosure defines an aerosol provision device comprising a hollow member arranged within the device to discourage capillary flow around the end. It has been found that when an article comprising aerosol generating material is heated within the device, aerosol can cool and condense inside the device. For example, aerosol can condense on inner surfaces of a chamber which receives the aerosol generating material. The liquid can run down the inside of the chamber, and capillary flow around an end of a hollow member positioned at one end of the chamber. For example, existing hollow members may have a flat rim or flange; the liquid runs down an inner surface of the hollow member and flows along the bottom end of the flat rim or flange. The liquid can then flow into other regions of the device.

It may be useful to reduce the capillary flow of liquid throughout the device. In some examples, the end of the hollow member may be configured to encourage the formation of liquid droplets. This may allow the liquid to be channeled into a receptacle. Accordingly, a modified hollow member or end portion of a chamber can be provided which limits capillary flow within the device by encouraging the formation of liquid droplets at its end. In other examples, droplets may not be form but capillary flow around the end may nevertheless be resisted, for example by ensuring that the gravitational force on the liquid is greater than the force from the surface tension to drive the capillary flow.

In a first example, the hollow member has a narrow wall thickness at the end. Thus, rather than having a flat rim or flange, the hollow member has a thin or "sharp" end to reduce the likelihood of capillary flow around the end of the hollow member. Liquid will gather at the end of the hollow member where the wall thickness is narrowest. The gravitational force exerted on the liquid is sufficient to prevent capillary flow around the end surface. As the volume of liquid at the end increases droplets may form and overcome the surface tension of the liquid at the end surface of the hollow member such that it drips from the end of the hollow member. The region of reduced wall thickness can provide an air gap between the hollow member and other components within the device. The liquid at the end of the hollow member cannot capillary flow across the air gap, so the volume of liquid builds up until a droplet drips from the end the hollow member.

An example aerosol provision device comprises a housing, where the housing/device delimits a first opening at a first end through which to receive aerosol generating material. The housing/device further delimits a second opening at a second end of the housing/device. The second opening may allow a user to access the device for cleaning. The housing may be at least partially defined by an outer cover and one or more end members, for example. The first opening may be arranged at a mouth end of the device. The second opening may be arranged at a distal end of the device. The second end may be opposed from the first end.

The hollow member can be arranged within the housing adjacent to or at the second opening. Thus, one end of the hollow member is facing the second opening but need not be contiguous with the second opening. The hollow member extends at least partially between the first and second openings. That is, the hollow member can fully extend from the second opening to the first opening, or may only extend for part of the distance between the second and first openings.

The hollow member may define an axis, for example a longitudinal axis. An outer wall of the hollow member at the end of the hollow member has a first wall thickness measured in a direction perpendicular to the axis. A part of the hollow member arranged closer to the first end of the housing than the end of the hollow member has a second wall thickness measured in a direction perpendicular to the axis. The first wall thickness is smaller than the second wall thickness.

The narrowest wall thickness of the hollow member may therefore be located at the end of the hollow member.

The hollow member may be tubular. The hollow member comprises a through hole extending through the hollow member in a direction along the axis. The through hole has an inner diameter/width measured in a direction perpendicular to the longitudinal axis. The hollow member has an inner surface (provided by the through hole) along which the liquid can flow. Air may be drawn through the second opening and through the hollow member towards the first opening when a user draws on the device.

The hollow member may form at least part of a chamber that extends through the housing between the first and second openings. A susceptor may form another part of the chamber. The hollow member may be known as a tube, cleanout tube or support. The end of the hollow member may define the second opening. The hollow member may support the susceptor at its other end.

In some examples, the wall thickness of at least part of the hollow member narrows/decreases towards the second opening. For example, an end portion of the hollow member may have a wall thickness that tapers from the second wall thickness to the first wall thickness. The end portion may have a tapered wall thickness that reduces along its length. The narrowest wall thickness is towards or at the end of the hollow member. In some examples, the end portion is positioned adjacent the second opening.

A tapered wall thickness can provide a more robust hollow member because the hollow member can have a reduced wall thickness at its end without having an end portion with a constant/uniform wall thickness. An end portion with a constant/uniform wall thickness may be prone to breakage if the wall thickness is small. A tapered wall thickness can also be easier to manufacture.

The end portion of the hollow member comprises the end of the hollow member that faces the second opening. The portion of the hollow member arranged closer to the first end may be arranged directly adjacent the end portion.

The tapered wall thickness may have a constant taper, or it may have a non-constant or varying taper.

The end surface or face of the hollow member may be flat in some examples. In other examples it may be curved, with a constant or varying radius of curvature. When the end surface is curved the maximum radius of curvature may be about 0.25 mm.

The wall thickness may be reduced by decreasing the outer width/diameter of hollow member towards the end of the hollow member. Thus, in some examples, the second opening lies in a plane that is perpendicular to the longitudinal axis, and an outer surface of the hollow member is inclined with respect to the plane, such that the wall thickness of the end portion decreases towards the second opening. In other words, the end portion of the hollow member may be a hollow frustum.

In one example, the hollow frustum has a slant angle that is less than about 70°. That is, an angle subtended between the longitudinal axis and the outer surface of the hollow member extended to meet the longitudinal axis is less than about 70°. This angle may also be referred to as a draft angle or taper angle. It has been found that when the end portion has a slant angle of less than about 70°, the effect of capillary flow around the end surface of the hollow member can be reduced because gravity acts to reduce capillary flow along the inclined surface. For comparison, existing hollow members may have a flat rim or flange, and the angle subtended between the longitudinal axis and the end surface of the flat rim or flange is about 90°. An inclined outer surface of less than about 70° is sufficient for liquid to build up at the end of the hollow member such that the gravitational force of the liquid overcomes the surface tension of the liquid, thereby encouraging a drop to form at the end of the hollow member.

The slant angle of the frustum may be less than about 45°, less than about 30°, or less than about 25°. Decreasing the slant angle makes the end profile more effective at reducing capillary flow because the effect of gravity to reduce capillary flow on the inclined surface is increased. Decreasing the slant angle helps to reduce capillary flow regardless of the velocity of liquid at the end of the hollow member.

The frustum may be a right frustum, such as a right circular conical frustum.

The end portion of the hollow member has a length dimension measured in a direction parallel to the longitudinal axis, and wherein the length dimension is between about 0.5 mm and about 5 mm, such as between about 0.5 mm and about 2 mm. It has been found that having a reduced wall thickness region of this length provides a good balance between overcoming the effects of capillary flow (by ensuring the wall thickness is reduced over a sufficient length) and ensuring the hollow member does not become too fragile (by ensuring the wall thickness is not reduced over a region that is too great). In examples where the end portion is a hollow frustum, this length will also depend on the slant angle.

The first wall thickness may be less than about 0.5 mm. A wall thickness of less than 0.5 mm has been found to help reduce the effects of capillary flow by encouraging liquid droplets to form at the end of the hollow member. In some examples, the first wall thickness may be less than about 0.25 mm or less than about 0.1 mm.

The first wall thickness may be less than about 50% of the second wall thickness. Thus, an air gap is provided along the edge of the end portion which can reduce or stop the effect of capillary flow. In some examples, the first wall thickness is also greater than about 10% of the second wall thickness to help provide structural integrity for the end portion.

In a second example, the hollow member defines an axis, such as a longitudinal axis, and the hollow member comprises an end portion positioned adjacent the second opening and having an external width dimension in a direction perpendicular to the axis that reduces or narrows towards the end. The reduced width of the end portion can provide an air gap between the end portion of the hollow member and other components within the device. The liquid at the end of the hollow member cannot cross the air gap, and so remains at the end, possibly forming a droplet as the volume of liquid builds up.

The width dimension is measured between opposing outer surfaces of the hollow member.

The end portion may be a hollow frustum.

The end portion may have a constant wall thickness or a non-constant wall thickness.

In any of the above examples, the device may comprise absorbent material arranged to receive the liquid from the end of the hollow member. The absorbent material can reduce the likelihood of the liquid from leaking out of the device, through air inlets for example. Once absorbed by the absorbent material, the liquid may then evaporate during storage periods or be substantially retained within the absorbent member. The absorbent material may be removable from the device, so that it can be cleaned and replaced within the device; emptied and replaced within the device; emptied, cleaned and replaced within the device; or disposed of and replaced with a new absorbing member.

In some examples, the bottom of the device comprises a cover or door, also known as a cleanout door, which allows a user to access the hollow member for cleaning. The cover may be movable between a first position in which the second opening is blocked by the door and a second position in which the second opening is not blocked, and the cover comprises a recess positioned adjacent the second opening when the cover is in the first position to receive the liquid droplets from the end of the hollow member. When a user opens the cover, the liquid can be poured out of the recess. The second opening is not blocked as long as access to the second opening is possible, for example the second opening may still be partially blocked or covered by the cover. In some examples, in the second position access to the opening is substantially unobstructed by the cover.

In some examples, the door/cover is detachable from the device. This can allow the user to more easily dispose of the absorbent material, and/or to pour any excess liquid out of the recess. The cover may be fully detachable from the device.

In some examples, the recess comprises absorbent material positioned at least partially in the recess for absorbing liquid.

In one example, the cover delimits one or more apertures for air to pass through, and the apertures may be arranged outside of the recessed portion of the cover. Thus, even when the absorbent material is saturated, or the recessed portion comprises liquid, the liquid is prevented from leaking out of the cover. The one or more apertures may be known as air inlets.

In use, the absorbent material may be at least partially positioned between the aerosol generating material and the cover. That is, the absorbent material and aerosol generating material may be arranged within the device at the same time. For example, the aerosol generating material may be arranged within a first section of the chamber and the absorbent material may be arranged in a second section of the chamber or may be arranged in the recess of the cover. This allows the liquid to be absorbed when the device is being used (i.e. during a heating session).

The absorbent material may comprise foam, such as polyurethane foam or high density polyurethane foam, sponge, paper or cellulose acetate. These materials are lightweight, absorbent and relatively inexpensive to manufacture.

The absorbent material may comprise a filamentary tow material, also referred to as fibrous material, which can comprise cellulose acetate fibre tow. The filamentary tow can also be formed using other materials used to form fibres, such as polyvinyl alcohol (PVOH), polylactic acid (PLA), polycaprolactone (PCL), poly(1-4 butanediol succinate) (PBS), poly(butylene adipate-co-terephthalate) (PBAT), starch based materials, cotton, aliphatic polyester materials and polysaccharide polymers or a combination thereof. The filamentary tow may be plasticised with a suitable plasticiser for the tow, such as triacetin where the material is cellulose acetate tow, or the tow may be non-plasticised. Unless otherwise described, the tow can have any suitable specification, such as fibres having a 'Y' shaped or other cross section such as 'X' shaped, filamentary denier values between 2 and 20 denier per filament, for example between 4 and 14 denier per filament and total denier values of 5,000 to 50,000, for example between 10,000 and 40,000.

The absorbent material may have an absorption capacity of at least 7 grams of water per gram of absorbent material. In other example the absorption capacity may be at least 10 grams per gram or at least 15 grams per gram. Absorption capacity measures the weight of liquid which can be held by the material without leakage. Higher capacities are preferred to ensure that the absorbent material can retain a sufficient volume of liquid that might be encountered in use without leaking. For example, a higher absorption capacity allows more use of the aerosol provision device before the absorbent material needs to be emptied or replaced. In some examples, a hydrophilic polyurethane foam which is commercially available from Freudenberg Performance Materials, headquartered in Weinheim, Germany under the trade name Freudenberg 1012 is used. This has an absorption capacity of 20 grams per gram.

Absorption capacity in this case is measured by pouring water on a test piece of absorbent material, such as foam piece with a flat upper surface. The test piece rests on a surface of a weighing scale and is not constrained, for example the test piece is free to expand in size. The water is added until water is observed to leak from the absorbent material or pool on top of the absorbent material. This indicates that the foam is saturated and the absorption capacity has been reached. The weight at this point is recorded and used to calculate the absorption capacity based on the known weight of the dry foam tested.

In one example, the absorbent material forms at least part of a brush. Thus, the brush comprises the absorbent material. The brush therefore acts as an absorbent member to retain/hold the liquid. The brush may also hold solid particles, such as loose tobacco.

The brush may comprise absorbent material in the form of bristles or filaments. The brush may comprise absorbent material in the form of a mesh. Bristles, filaments and meshes are absorbent materials because they retain/hold liquid droplets within their structure. For example, liquid droplets can be trapped in the space between bristles/filaments. Similarly, a mesh may comprise a structure of intertwined or woven strands which retain/hold liquid droplets in the spaces between them.

The brush may comprise absorbent material supported by a substrate. The substrate may form a "backbone" to which the bristles, filaments or mesh are attached.

As in other examples, the absorbent member may be removed from the device and either disposed of, or cleaned and replaced back into the device.

In examples comprising absorbent material, at least a portion of the absorbent material may be configured to provide a visual indication to indicate that the absorbent material is ready to be replaced or cleaned. For example, the absorbent material may be ready to be replaced or cleaned when a predetermined volume of liquid has been absorbed by the absorbent material or when the absorbent material has been used for a predetermined length of time.

In one example, the visual indication is a change in colour of the portion of the absorbent material. For example, the absorbent material may be configured to change from a first colour to a second colour, where the first and second colours are different (or are at least distinguishable from each other).

In some examples, the liquid has a third colour, and the second colour is different to the third colour. Thus, the absorbent material may not turn the same colour as the liquid.

The change in colour may occur non-uniformly across the absorbent material. For example, an end of the absorbent material nearest the aerosol generating material may change colour first, and an end furthest away from the aerosol generating material may change colour at a later time. A user may clean or replace the absorbent material when the whole of the absorbent material has changed colour. In other examples, the change in colour may occur substantially uniformly across the absorbent material. A user may clean or replace the absorbent material when the shade of the colour suggests doing so.

In one example, the change in colour occurs due to a change in pH value. The absorbent material may therefore comprise a chemical indicator, such as a dye, to provide the visual indication. Thus, in one example, the absorbent material changes colour as a result of the pH value of the liquid.

In another example, the change in colour occurs due to a change in temperature. The absorbent material can therefore change colour due to exposure to heat, such as heat of the liquid.

In one example, the absorbent material comprises a capsule comprising a coloured indicator within a shell, wherein the shell is configured to break down and release the coloured indicator to provide the visual indication. The shell can therefore break down over time. In one example, the shell is dissolvable and dissolves due to exposure to the liquid. The coloured indicator, such as a dye, can then leak out of the capsule when the shell has dissolved. In one example, the shell dissolves due to the presence of water or glycerol within the liquid. Preferably the shell dissolves due to the presence of glycerol but not water to ensure that the shell does not break down outside of the device and/or when not in use due to moisture within the air. In another example, the shell breaks down due a chemical reaction with one or more chemicals within the liquid. In a further example, the shell breaks down due to an exposure to heat within the device. In a particular example, there are a plurality of capsules each comprising a coloured indicator within a shell, where each shell is configured to break down at a different time. For example, a first capsule may release a first colour chemical indicator after one heating session, and a second capsule may release a second chemical indicator after another heating session. Each capsule can have a different shell thickness such that the shells break down at different times.

In one example, a first portion of the absorbent material is configured to provide a visual indication to indicate that the absorbent material is ready to be replaced or cleaned. A second portion of the absorbent material may provide a different visual indication or may not provide a visual indication.

In some examples, the first portion may be configured to change from a first colour to a second colour, where the first and second colours are different (or are at least distinguishable from each other). The liquid may have a third colour, and the second portion may be configured to change from a fourth colour to the third colour. Thus, in some examples, the first portion is configured to change to a colour that is different to the colour of the liquid and the second portion is only coloured naturally by the liquid, and so does not change to the same colour as the first portion.

In a particular example, the first portion is arranged at a first end of the absorbent material, and the second portion is arranged at a second end of the absorbent material, where the first end is an end furthest away from the aerosol generating material (i.e. at the distal end of the absorbent material) and the second end is an end closest to the aerosol generating material (i.e. at a proximal end). This may be useful because it shows that liquid has penetrated through the entire length of the absorbent material, and so indicates that the absorbent material is ready to be cleaned or replaced.

In some examples, the one or more chemical indicators or dyes are Generally Recognised As Safe (GRAS) by the Food and Drug Administration (FDA). For example, the dyes may be w food acceptable and optionally, a food grade material. The chemical indicators may therefore be non-toxic and safe for ingestion. This is useful because the indicators may be heated and aerosolised so may be inhaled or ingested by a user.

In one example, the visual indication comprises the appearance of a particular pattern. For example, one or more markings or indicia may appear when the absorbent material is ready to be replaced or cleaned. In some examples the pattern changes from a first pattern to a second pattern when the absorbent material is ready to be replaced or cleaned. The appearance of a particular pattern may also comprise a change in colour.

In some examples, the visual indication is visible from outside of the device, such as through a window or opening in the outer cover of the device. In other examples, the visual indication is visible on opening the cover.

At least a portion of the absorbent material may be gas permeable. A gas permeable absorbent material can allow gas to pass through it, for example in the direction towards the part of the chamber configured to receive the aerosol generating material. The pressure drop created by drawing through the absorbent material is preferably less than about 200 Pa (20 mm H2O), more preferably less than about 100 Pa (10 mm H2O) or less than 50 Pa (5 mm H2O). This will depend on the dimensions and material properties of the absorbent material in the flow path and be tested by determining the difference in pressure drop across the whole aerosol provision device with and without the absorbent material in place.

The absorbing member may cover one or more air inlets. The absorbing member therefore stops or reduces the likelihood of liquid from leaking out of the air inlets. As mentioned, the air inlets may be apertures formed in the cover.

In any of the above examples, the device may additionally or alternatively comprise a hydrophobic material, such as a hydrophobic layer or membrane arranged at least partially in the recess. The hydrophobic material provides a liquid impermeable layer which stops the liquid soaking through the absorbent material and out of the door. The hydrophobic material may comprise polyethylene terephthalate (PET). PET is lightweight, flexible, cheap, and has high melting point (to avoid the hydrophobic material from deforming during a heating session).

In a particular example, an absorbent material is arranged on a hydrophobic material. Thus, the absorbent material is arranged closer to the first opening than the hydrophobic material is (i.e. the absorbing member is arranged between the hydrophobic material and the aerosol generating material). The hydrophobic material may therefore stop any liquid which soaks through the absorbing member.

In an alternative example the hydrophobic material is arranged closer to the first opening than the absorbent material is (i.e. the hydrophobic material is arranged between the absorbent material and the aerosol generating material).

In some examples, at least a portion of the hollow member is hydrophobic or comprises a hydrophobic coating to encourage the liquid to flow. The liquid can be encouraged to flow towards the absorbent material and/or hydrophobic material.

In some examples, at least a portion of the hollow member is formed from polypropylene or polyethylene. A portion of the hollow member may be coated in a layer of polypropylene or polyethylene in certain examples. Polypropylene and polyethylene are examples of hydrophobic materials.

In particular examples, at least a portion of the hollow member's surface is modified to increase the hydrophobicity of the surface. One example of modifying the surface is polishing the surface, so that the surface is a polished surface.

In any of the above examples, the hollow member may have an inner diameter that narrows towards the end. The inner diameter is measured in a direction perpendicular to the longitudinal axis. The inner surface of the hollow member is therefore tapered. This narrowing inner diameter can increase the time taken for the liquid condensate to flow towards the end of the hollow tube. By increasing this time, the condensation may be re-heated and evaporated as the hollow member increases in temperature. This reduces the volume of liquid within the device, and the likelihood of leakage is reduced.

The hollow member preferably has a smallest inner diameter at the end of the hollow member. In other examples, the smallest inner diameter is at a location less than about 50% of the length of the hollow member away from the end of the hollow member. The smallest inner diameter may be at a location less than about 25%, less than about 10% or less than about 5% of the length of the hollow member away from the end of the hollow member.

Such a hollow member is particularly useful in aerosol provision devices having an inductive heater. Inductive heaters typically heat up much quicker than resistive heaters, which can mean that condensation is more of a problem than in resistive heating systems.

An angle of greater about 1° may be subtended between an inner surface of the hollow member and the longitudinal axis of the hollow member. It has been found that even a small incline can reduce the time taken for the liquid to flow to the end of the hollow member to have an effect on the amount of liquid escaping from the hollow member.

In any of the above examples, the hollow member may have an inner surface comprising one or more ridges or grooves configured to impede any liquid flow along the inner surface towards the second opening. By providing the hollow member with a "rough" or contoured surface, the time taken for the liquid to flow towards the end of the hollow member is increased. In one example the inner surface of the hollow member comprises a helical channel formed around the inner surface.

In another aspect, there is provided a hollow member for an aerosol provision device. The hollow member may have any of the features described above. For example, an end portion of the hollow member may be a hollow frustum and have wall thickness that tapers towards an end of the hollow member.

In a further aspect, an aerosol provision device, comprises a housing, at least one inductive heater and a hollow member. The housing delimits a first opening at a first end of the housing through which to receive aerosol generating material and delimits a second opening at a second end of the housing. At least one inductive heater is arranged within the housing and configured to heat the aerosol generating material received within the housing thereby to generate an aerosol. A hollow member is arranged within the housing and extends at least partially between the second and first openings. The hollow member has a first end in the direction towards the first opening and a second end in the direction towards the second opening.

An inner diameter of the hollow member reduces towards the second end. A minimum inner diameter of the hollow member is positioned less than about 50% of the distance from the second end to the first end. In other example, the minimum inner diameter may be positions less than about 25%, less than about 10% or less than about 5% of the distance from second end to the first end. In this way, the minimum inner diameter is closer to the second end than to the first end.

Another aspect of the present disclosure defines an aerosol provision device, comprising a housing delimiting a first opening at a first end of the housing, through which to receive aerosol generating material, and delimiting a second opening at a second end of the housing. The device further comprises a chamber positioned between the second opening and the first opening, w wherein at least part of the chamber is configured to receive the aerosol generating material. The device further comprises at least one heater arranged within the housing and configured to heat aerosol generating material received within the chamber thereby to generate an aerosol. The device further comprises a removable cover configured to receive liquid from the chamber, the removable cover being attachable to the aerosol provision device in a position in which the second opening is blocked by the cover.

The device therefore comprises a removable/detachable cover/door. The cover is therefore configured to receive liquid from the chamber and can be detached to allow the collected liquid to be disposed of A detachable cover can allow the user to more easily dispose of the liquid and/or absorbent/hydrophobic material (if present). The detachable nature of the cover can also allow the cover to be cleaned, which is particularly useful if the device itself is not water resistant.

In some examples, the cover comprises a liquid reservoir to receive the liquid. The cover may be adapted to: (i) allow liquid to flow into the reservoir, and (ii) substantially restrict liquid from flowing out of the reservoir. For example, the cover may comprise a one-way valve to stop liquid from leaking out of the reservoir. Alternatively, the reservoir may have an opening shaped to allow ingress of liquid, but which restricts egress of liquid.

In some examples, the cover comprises absorbent material. For example, the cover may comprise a recess and the absorbent material is arranged at least partially in the recess. In some examples, the absorbent material is removably adhered to the cover. A user can remove the absorbent material, and either clean or dispose of it, before adhering clean absorbent material back onto the cover. In further examples, the absorbent material is not removable/detachable from the cover. The door can be detached so that the absorbent material can be cleaned.

In some examples, the cover comprises hydrophobic material. For example, the cover may comprise a recess and the hydrophobic material is arranged at least partially in the recess. In some examples, the hydrophobic material is removably adhered to the cover. A user can remove the hydrophobic material, and either clean or dispose of it, before adhering clean hydrophobic material back onto the cover.

In some examples, at least a portion of the chamber is hydrophobic or comprises a hydrophobic coating to encourage the liquid to flow towards the cover.

According to another aspect, there is provided an aerosol provision device, comprising a housing delimiting a first opening at a first end of the housing through which to receive aerosol generating material and delimiting a second opening at a second end of the housing. The device further comprises a chamber positioned between the second opening and the first opening, wherein at least part of the chamber is configured to receive the aerosol generating material. The device further comprises at least one heater arranged within the housing and configured to heat aerosol generating material received within the chamber thereby to generate an aerosol. The device further comprises a brush configured to receive and retain residue from the chamber. In use, the aerosol is drawn along a flow path through the chamber towards the first opening and the brush is at least partially positioned upstream of the part of the chamber configured to receive the aerosol generating material.

In some examples, the brush receives and retains liquid residue from the chamber. In other examples, the brush receives and retains solid residue from the chamber. The brush can be removed from the device and be cleaned or disposed of. The brush may be positioned fully in the chamber, or may be partially positioned in the chamber. In some examples, the cover/door comprises a recess and the brush is arranged at least partially in the recess.

In one example, the brush comprises absorbent material. The brush therefore acts as an absorbent member and can absorb/hold liquid.

In another aspect, a system comprises an aerosol provision device as discussed above and aerosol generating material at least partially contained within the housing.

FIG. 1 shows an example of an aerosol provision device 100 for generating aerosol from an aerosol generating medium/material. In broad outline, the device 100 may be used to heat a replaceable article 110 comprising the aerosol generating medium, to generate an aerosol or other inhalable medium which is inhaled by a user of the device 100. The device is a tobacco heating device, also known as a heat-not-burn device.

The device 100 comprises a housing 102 (defined at least partially by an outer cover) which surrounds and houses various components of the device 100. The device 100 or housing 102 has a first opening 104 in one end, through which the article 110 may be inserted for heating by a heating assembly. In use, the article 110 may be fully or partially inserted into a heating chamber where it may be heated by one or more components of the heater/heater assembly.

The device 100 of this example comprises a first end member 106 which comprises a lid 108 which is moveable relative to the first end member 106 to close the first opening 104 when no article 110 is in place. In FIG. 1, the lid 108 is shown in an open configuration, however the lid 108 may move into a closed configuration. For example, a user may cause the lid 108 to slide in the direction of arrow "A".

The device 100 may also include a user-operable control element 112, such as a button or switch, which operates the device 100 when pressed. For example, a user may turn on the device 100 by operating the switch 112.

The device 100 may also comprise an electrical component, such as a socket/port 114, which can receive a cable to charge a battery of the device 100. For example, the socket 114 may be a charging port, such as a USB charging port.

Figure 2:
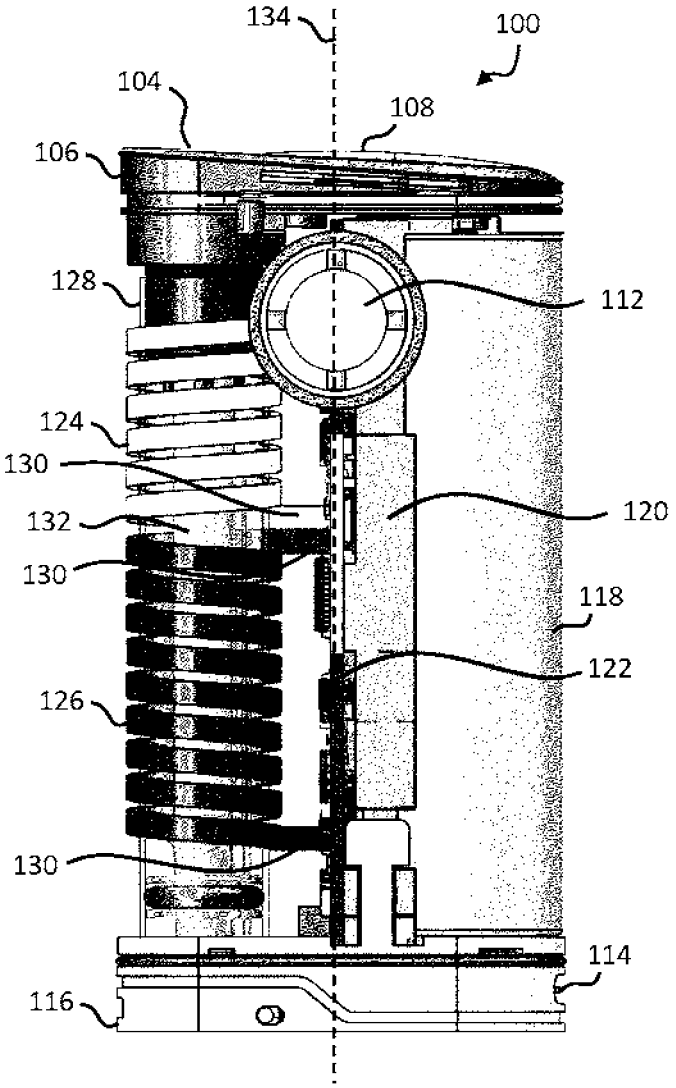
FIG. 2 shows a front view of the aerosol provision device of FIG. 1 with an outer cover removed.

FIG. 2 depicts the device 100 of FIG. 1 with the outer cover 102 removed and without an article 110 present. The device 100 defines a longitudinal axis 134.

As shown in FIG. 2, the first end member 106 is arranged at one end of the device 100 and a second end member 116 is arranged at an opposite end of the device 100. The first and second end members 106, 116 together at least partially define end surfaces of the device 100. For example, the bottom surface of the second end member 116 at least partially defines a bottom surface of the device 100. In this example, the lid 108 also defines a portion of a top surface of the device 100. First and second end members 106, 116 are part of the device housing, such that the housing defines the first opening 104.

The end of the device 100 closest to the first opening 104 may be known as the proximal end (or mouth end) of the device 100 because, in use, it is closest to the mouth of the user. In use, a user inserts an article 110 into the first opening 104, operates the user control 112 to begin heating the aerosol generating material and draws on the aerosol generated in the device. This causes the aerosol to flow through the device 100 along a flow path towards the proximal end of the device 100.

The other end of the device furthest away from the first opening 104 may be known as the distal end of the device 100 because, in use, it is the end furthest away from the mouth of the user. As a user draws on the aerosol generated in the device, the aerosol flows away from the distal end of the device 100.

The device 100 further comprises a power source 118. The power source 118 may be, for example, a battery, such as a rechargeable battery or a non-rechargeable battery. The battery is electrically coupled to the heating assembly to supply electrical power when required and under control of a controller (not shown) to heat the aerosol generating material. In this example, the battery is connected to a central support 120 which holds the battery 118 in place.

The device further comprises at least one electronics module 122. The electronics module 122 may comprise, for example, a printed circuit board (PCB). The PCB 122 may support at least one controller, such as a processor, and memory. The PCB 122 may also comprise one or more electrical tracks to electrically connect together various electronic components of the device 100. For example, the battery terminals may be electrically connected to the PCB 122 so that power can be distributed throughout the device 100. The socket 114 may also be electrically coupled to the battery via the electrical tracks.

In the example device 100, the heating assembly is an inductive heating assembly and comprises various components to heat the aerosol generating material of the article 110 via an inductive heating process. Induction heating is a process of heating an electrically conducting object (such as a susceptor) by electromagnetic induction. An induction heating assembly may comprise an inductive element, for example, one or more inductor coils, and a device for passing a varying electric current, such as an alternating electric current, through the inductive element. The varying electric current in the inductive element produces a varying magnetic field. The varying magnetic field penetrates a susceptor suitably positioned with respect to the inductive element and generates eddy currents inside the susceptor. The susceptor has electrical resistance to the eddy currents, and hence the flow of the eddy currents against this resistance causes the susceptor to be heated by Joule heating. In cases where the susceptor comprises ferromagnetic material such as iron, nickel or cobalt, heat may also be generated by magnetic hysteresis losses in the susceptor, i.e. by the varying orientation of magnetic dipoles in the magnetic material as a result of their alignment with the varying magnetic field. In inductive heating, as compared to heating by conduction for example, heat is generated inside the susceptor, allowing for rapid heating. Further, there need not be any physical contact between the inductive heater and the susceptor, allowing for enhanced freedom in construction and application.

The induction heating assembly of the example device 100 comprises a susceptor arrangement 132 (herein referred to as "a susceptor"), a first inductor coil 124 and a second inductor coil 126. The first and second inductor coils 124, 126 are made from an electrically conducting material. In this example, the first and second inductor coils 124, 126 are made from w a multi-strand wire, such as a litz wire/cable which is wound in a generally helical fashion to provide the inductor coils 124, 126. Litz wire comprises a plurality of wire strands which are individually insulated and are twisted together to form a single wire. Litz wires are designed to reduce the skin effect losses in a conductor. In the example device 100, the first and second inductor coils 124, 126 are made from copper Litz wire which has a rectangular cross section. In other examples the Litz wire can have other shape cross sections.

The first inductor coil 124 is configured to generate a first varying magnetic field for heating a first section of the susceptor 132 and the second inductor coil 126 is configured to generate a second varying magnetic field for heating a second section of the susceptor 132. In this example, the first inductor coil 124 is adjacent to the second inductor coil 126 in a direction parallel to the longitudinal axis 134 of the device 100. Ends 130 of the first and second inductor coils 124, 126 can be connected to the PCB 122.

It will be appreciated that the first and second inductor coils 124, 126, in some examples, may have at least one characteristic different from each other. For example, the first inductor coil 124 may have at least one characteristic different from the second inductor coil 126. More specifically, in one example, the first inductor coil 124 may have a different value of inductance than the second inductor coil 126. In FIG. 2, the first and second inductor coils 124, 126 are of different lengths such that the first inductor coil 124 is wound over a smaller section of the susceptor 132 than the second inductor coil 126. Thus, the first inductor coil 124 may comprise a different number of turns than the second inductor coil 126 (assuming that the spacing between individual turns is substantially the same). In yet another example, the first inductor coil 124 may be made from a different material to the second inductor coil 126. In some examples, the first and second inductor coils 124, 126 may be substantially identical.

The susceptor 132 of this example is hollow and therefore defines at least part of a chamber within which aerosol generating material is received. For example, the article 110 can be inserted into the susceptor 132. In this example the susceptor 120 is tubular, with a circular cross section.

The susceptor 132, and the first and second inductor coils 124, 126 may form at least part of the heater/heater assembly. The heated susceptor 132 therefore heats aerosol generating material received within the housing/device.

The device 100 of FIG. 2 further comprises an insulating member 128 which may be generally tubular and at least partially surround the susceptor 132. The insulating member 128 may be constructed from any insulating material, such as plastic for example. In this particular example, the insulating member is constructed from polyether ether ketone (PEEK). The insulating member 128 may help insulate the various components of the device 100 from the heat generated in the susceptor 132.

The insulating member 128 can also fully or partially support the first and second inductor coils 124, 126. For example, as shown in FIG. 2, the first and second inductor coils 124, 126 are positioned around the insulating member 128 and are in contact with a radially outward surface of the insulating member 128. In some examples the insulating member 128 does not abut the first and second inductor coils 124, 126. For example, a small gap may be present between the outer surface of the insulating member 128 and the inner surface of the first and second inductor coils 124, 126.

In a specific example, the susceptor 132, the insulating member 128, and the first and second inductor coils 124, 126 are coaxial around a central longitudinal axis of the susceptor 132.

Figure 3:
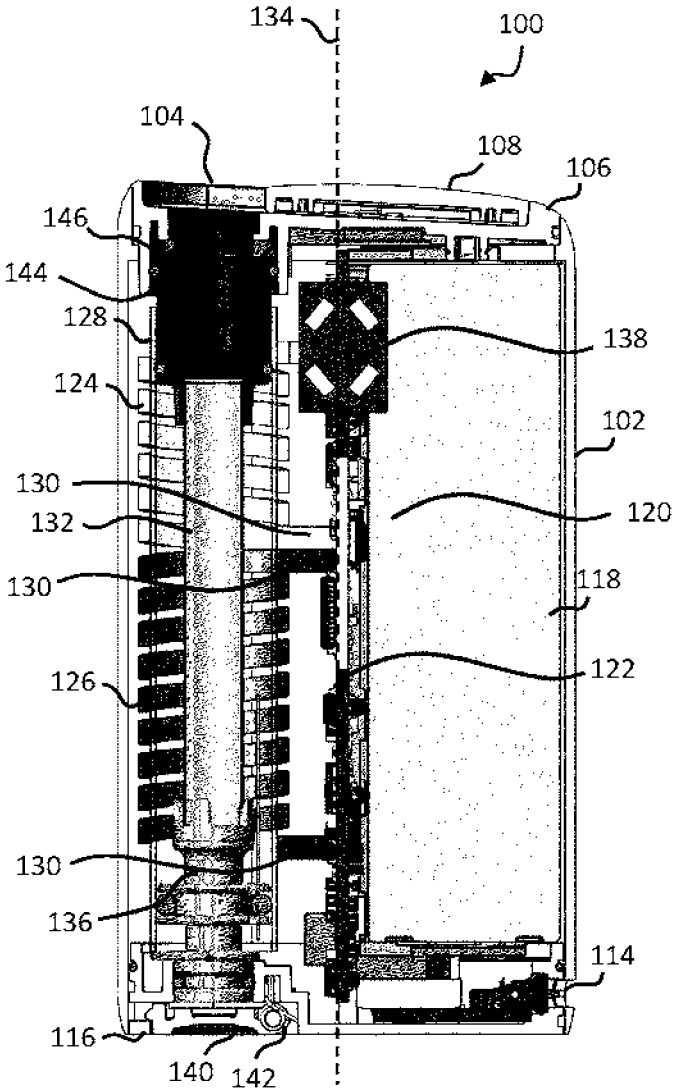
FIG. 3 shows a cross-sectional view of the aerosol provision device of FIG. 1.

FIG. 3 shows a side view of device 100 in partial cross-section. The outer cover 102 is present in this example.

The device 100 further comprises a hollow member 136 which engages one end of the susceptor 132 to hold the susceptor 132 in place. The hollow member 136 is connected to the second end member 116. The hollow member 136 may also be known as a support, a tube, or a cleanout tube. The hollow member is positioned adjacent a second opening and extends towards the first opening.

The device may also comprise a second printed circuit board 138 associated within the control element 112.

The device 100 further comprises a cover or door 140 and a spring 142, arranged towards the distal end of the device 100. The spring 142 allows the door 140 to be opened, to provide access to a second opening formed in the housing. The second opening may be defined by an end of the hollow member 136, for example. Through the second opening, a user may access the chamber to clean the susceptor 132 and/or the hollow member 136. The device 100 or housing 102 therefore defines the second opening at the second end of the device/housing. Similarly, the device 100 or housing 102 defines the first opening 104 at the first end of the device/housing. The first and second ends may be opposite to each other. A chamber or channel is formed between the door 140 and the first opening 104. For example, the chamber/channel may be at least partially defined by the hollow member 136 and the susceptor 132. The door 140 can be moved between two positions. In a first position, the second opening is covered by the door 140, and in a second position the second opening is not covered by the door 140.

The device 100 further comprises an expansion chamber 144 which extends away from a proximal end of the susceptor 132 towards the first opening 104 of the device. Located at least partially within the expansion chamber 144 is a retention clip 146 to abut and hold the article 110 when received within the device 100. The expansion chamber 144 is connected to the end member 106. The expansion chamber 144 may also define at least part of the chamber/channel.

Figure 4:
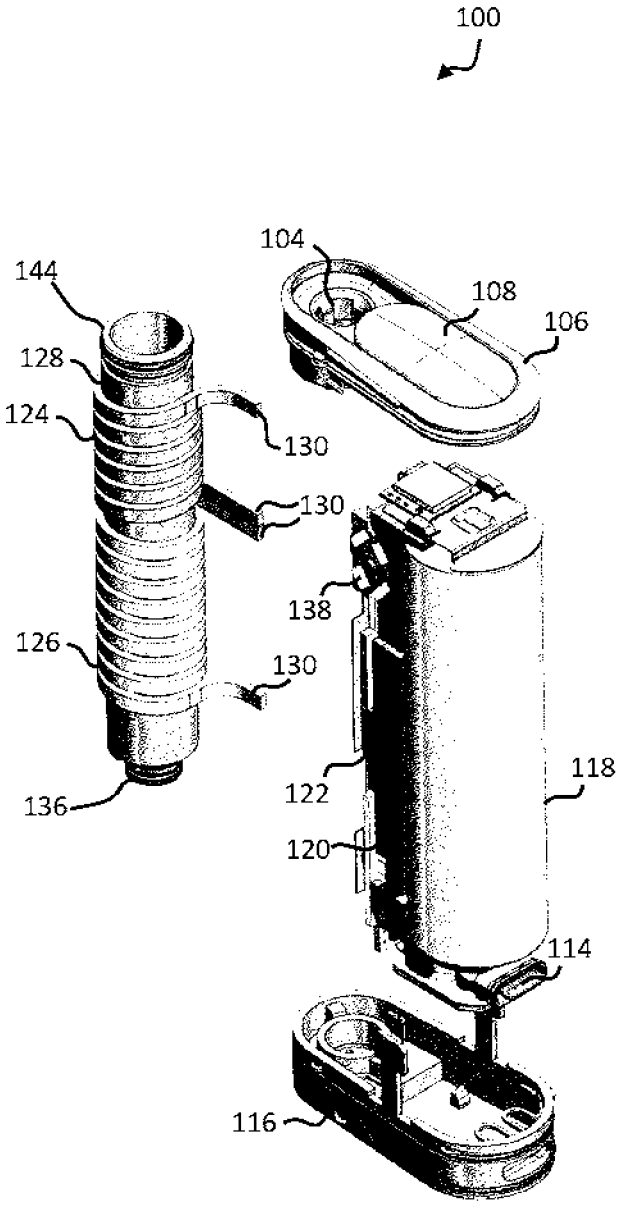
FIG. 4 shows an exploded view of the aerosol provision device of FIG. 2.

FIG. 4 is an exploded view of the device 100 of FIG. 1, with the outer cover 102 omitted.

Figure 5A:
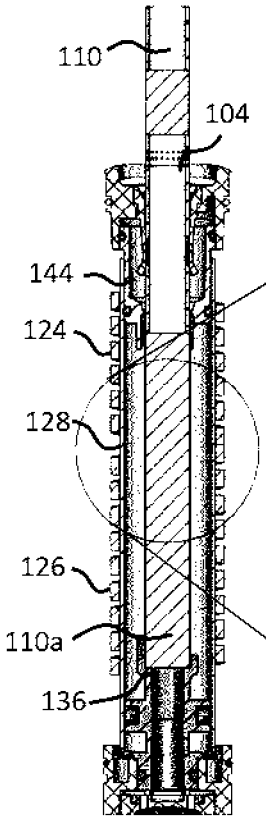
FIG. 5A shows a cross-sectional view of a heating assembly within an aerosol provision device.
Figure 5B:
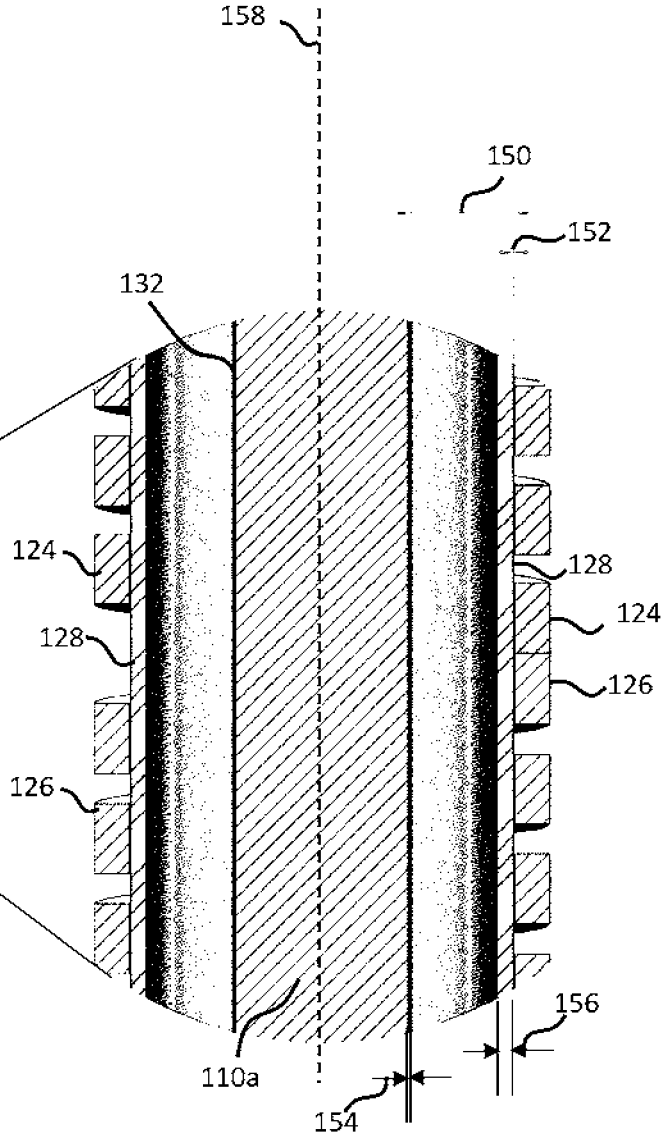
FIG. 5B shows a close-up view of a portion of the heating assembly of FIG. 5A.

FIG. 5A depicts a cross section of a portion of the device 100 of FIG. 1. FIG. 5B depicts a close-up of a region of FIG. 5A. FIGS. 5A and 5B show the article 110 received within the susceptor 132, where the article 110 is dimensioned so that the outer surface of the article 110 abuts the inner surface of the susceptor 132. The article 110 of this example comprises aerosol generating material 110*a*. The aerosol generating material 110*a* is positioned within the susceptor 132. The article 110 may also comprise other components such as a filter, wrapping materials and/or a cooling structure.

FIG. 5B shows that the outer surface of the susceptor 132 is spaced apart from the inner surface of the inductor coils 124, 126 by a distance 150, measured in a direction perpendicular to a longitudinal axis 158 of the susceptor 132. In one particular example, the distance 150 is about 3 mm to 4 mm, about 3 mm to 3.5 mm, or about 3.25 mm.

FIG. 5B further shows that the outer surface of the insulating member 128 is spaced apart from the inner surface of the inductor coils 124, 126 by a distance 152, measured in a direction perpendicular to a longitudinal axis 158 of the susceptor 132. In one particular example, the distance 152 is about 0.05 mm. In another example, the distance 152 is substantially 0 mm, such that the inductor coils 124, 126 abut and touch the insulating member 128.

In one example, the susceptor 132 has a wall thickness 154 of about 0.025 mm to 1 mm, or about 0.05 mm.

In one example, the susceptor 132 has a length of about 40 mm to 60 mm, about 40 mm to 45 mm, or about 44.5 mm.

In one example, the insulating member 128 has a wall thickness 156 of about 0.25 mm to 2 mm, 0.25 mm to 1 mm, or about 0.5 mm.

Figure 6A:
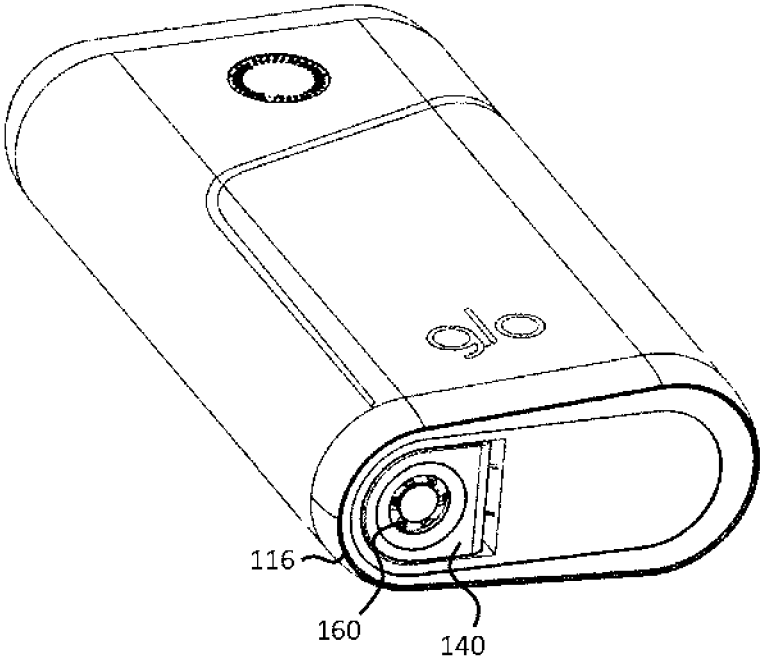
FIG. 6A shows a perspective view of the bottom end of the aerosol provision device with a door providing access to a second opening.

FIG. 6A depicts the distal/bottom end of the device 100. In FIG. 6A, the door 140 is arranged in first position in which the second opening to the chamber/hollow member 136 is closed. One or more apertures 160 form air inlets within the door 140. Air can be drawn into the chamber/hollow member 136 and through the device 100 towards the first opening 104 via the apertures 160.

Figure 6B:
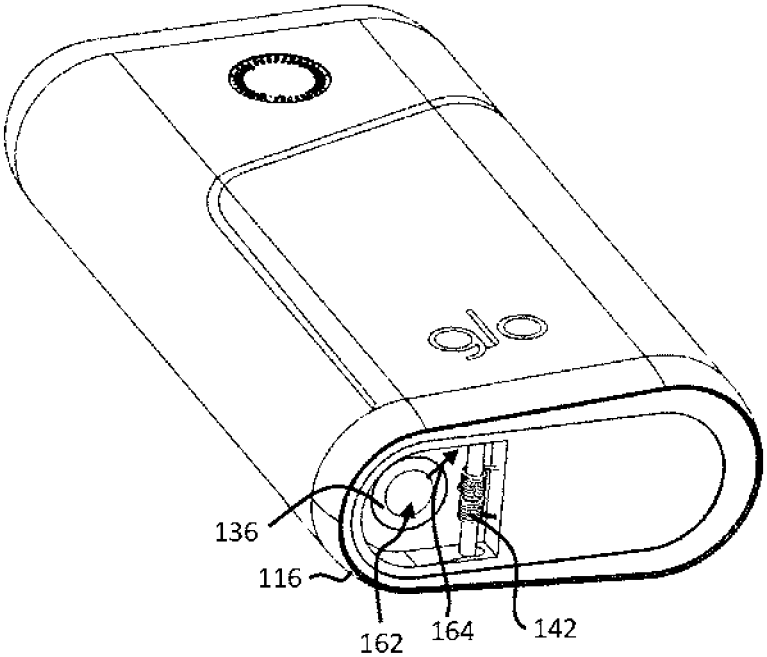
FIG. 6B shows a perspective view of the bottom end of the aerosol provision device with the door omitted.

FIG. 6B depicts the distal/bottom end of the device 100 with the door 140 omitted. The spring 142 and bottom end of the hollow member 136 are seen. The end of the hollow member 136 and/or the second end member 116 define the second opening 162. The hollow member 136 and susceptor 132 can be cleaned via the second opening 162. For example, a cleaning tool may be introduced into the chamber.

Figure 7:
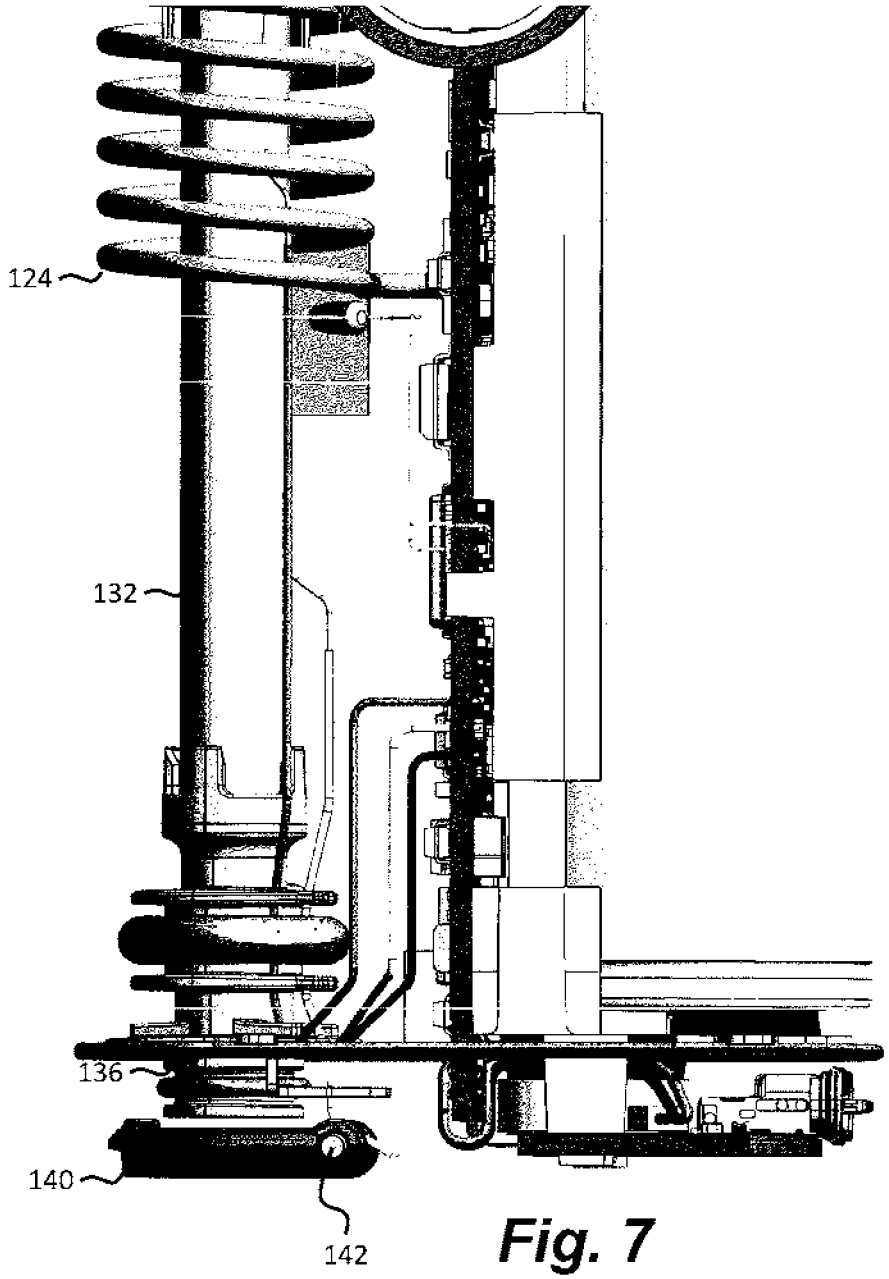
FIG. 7 shows a perspective view of the aerosol provision device with certain components of the heating assembly omitted.

FIG. 7 shows a perspective view of the aerosol provision device 100 with certain components of the heating assembly omitted. For example, the second inductor coil 126 is omitted. The susceptor 132 and the hollow member 136 at least partially define a chamber through which air and aerosol can flow. The susceptor 132 may form a first section of the chamber, which receives the aerosol generating material. The hollow member 136 supports one end of the susceptor 132 and may form a second section of the chamber.

It has been found that when an article comprising aerosol generating material is heated within the chamber of the device 100, aerosol can cool and condense inside the device. For example, aerosol can condense on inner surfaces of the hollow member 136 which is cooler than the susceptor 132. Condensation may also occur on the susceptor 132 as it cools after use or as different portions of the susceptor are heated to different temperatures. This condensate or liquid can run down the inside of the chamber and collect at the bottom of the device. For example, the liquid may collect in the door 140. The liquid may then leak out of the apertures 160 formed in the door 140 or may leak around the perimeter of the door. Furthermore, the liquid may leak out when the door 140 is opened.

In some examples, the liquid can capillary flow along an end of the hollow member 136 and on to other components of the device, such as an underside of the second end member 116. The arrow 164 in FIG. 6B shows the path liquid may take as it emerges from the bottom end of the hollow member 136. When the liquid takes this path, the liquid may be more likely to leak around the perimeter of the door 140.

Figure 8:
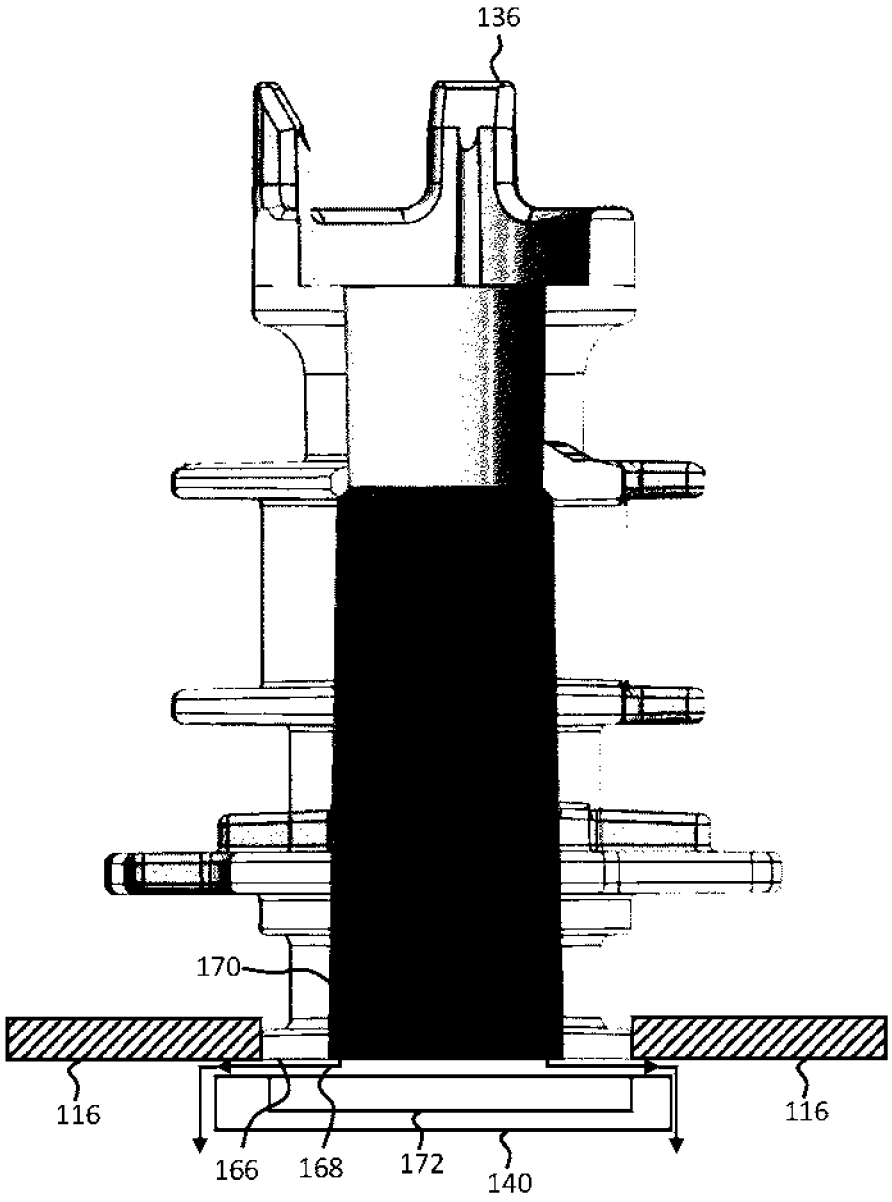
FIG. 8 shows a cross-sectional view of a hollow member that is not configured to encourage the formation of liquid droplets.

FIG. 8 shows a cross-sectional view of the hollow member 136 of FIGS. 6B and 7. The hollow member of this example has a flat end surface 166 provided by a flange. Arrow 168 shows the flow path of liquid as it flows down the inner surface 170 of the hollow member 136 and along the end surface 166 due to capillary flow. The liquid may even flow along the underside of the second end member 116. If the water flows far enough along the second end member 116, it may bypass the door 140 rather than flowing into a receptacle 172 formed in the door 140 as desired. The liquid which bypasses the door 140 may leak out of the device.

It may therefore be useful to reduce or stop the capillary flow of liquid around the end of the hollow member 136 to reduce or stop the leakage of liquid out of the device 100. Accordingly, a modified hollow member may be provided which limits capillary flow by encouraging the formation of liquid droplets at the end of the hollow member.

Figure 9A:
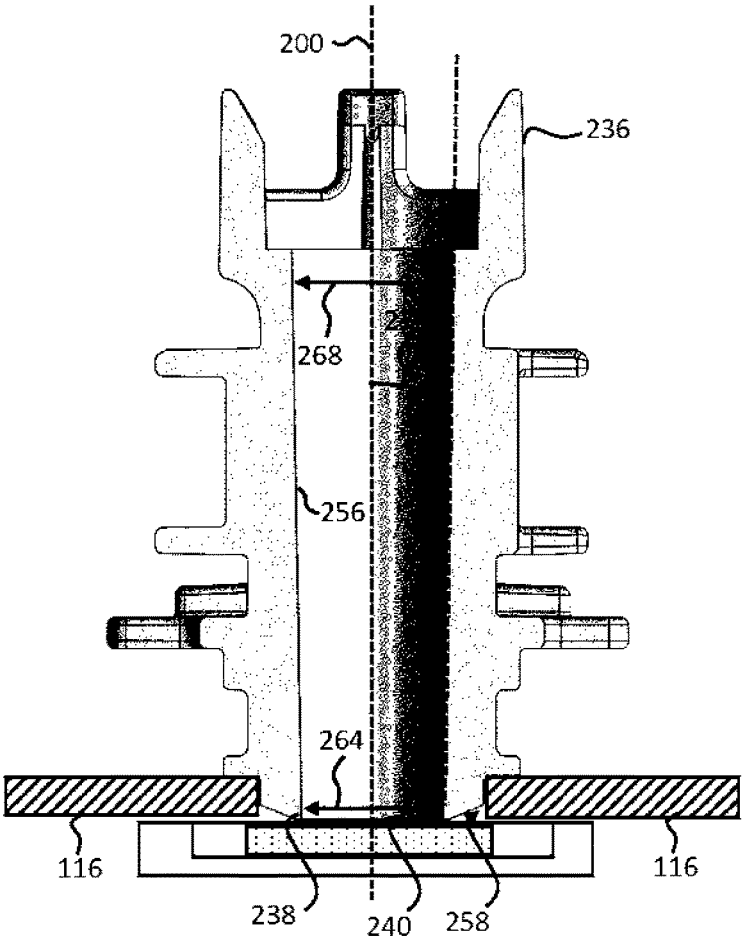
FIGS. 9A and 9B show cross-sectional views of a first example hollow member that is configured to encourage the formation of liquid droplets.
Figure 9B:
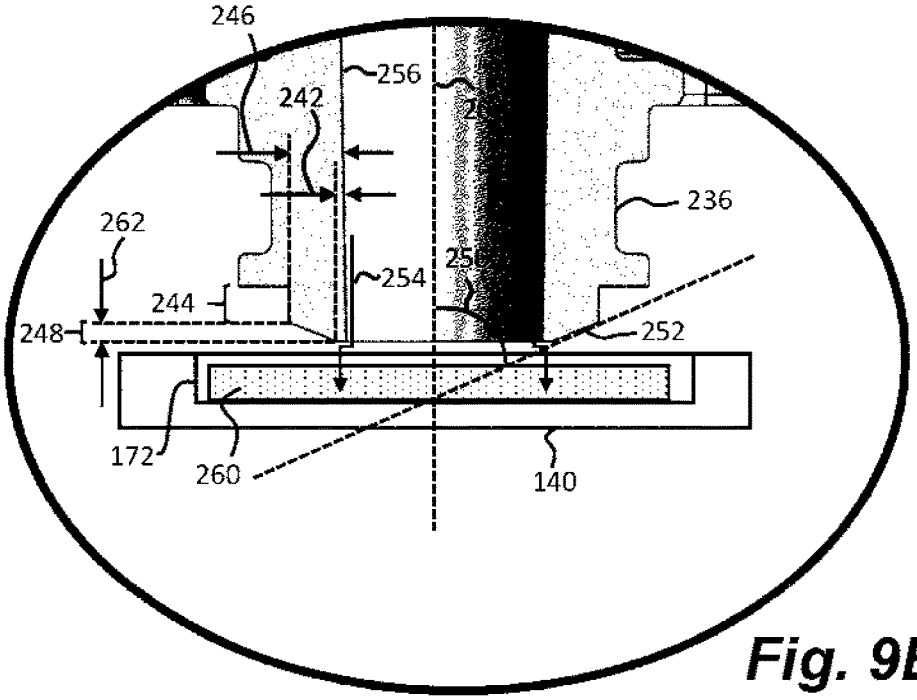

FIGS. 9A and 9B depict a cross-sectional view of a modified hollow member 236 that is adapted to reduce capillary flow within the device 100. FIG. 9B is a close-up view of a portion of FIG. 9A. The hollow member 236 may be used in the device 100 in place of the hollow member 136 depicted in FIG. 8.

The hollow member 236 has a narrow wall thickness at the end 238 the hollow member 236. The wall thickness of the hollow member 236 is measured in a direction perpendicular to a longitudinal axis 200 defined by the hollow member 236. Thus, rather than having a flat rim or flange (as in FIG. 7), the hollow member 236 has a thin or "sharp" end 238 to reduce the likelihood of capillary flow around the end of the hollow member 236.

The end 238 of the hollow member 236 facing the second opening 240 has a first wall thickness 242, and a portion 244 of the hollow member 236 arranged closer to the first end of the housing has a second wall thickness 246. To provide the sharp edge, the first wall thickness 242 is smaller than the second wall thickness 246. In this example, the narrowest wall thickness of the entire hollow member 236 is the first wall thickness 242. The portion 244 is located directly adjacent an end portion 248, where the end portion 248 extends away from the end 238 of the w hollow member 236 and has a wall thickness that is less than the second wall thickness 246. The end portion 248 positioned adjacent the second opening has wall thickness that tapers from the second wall thickness 246 to the first wall thickness 242. The wall thickness is therefore narrowing towards the end 238 of the hollow member 236.

The end portion 248 therefore has the form of a hollow frustum, with a slant angle 250 being subtended between an outer surface 252 of the end portion 248 and the longitudinal axis 200. In this particular example, the slant angle 250 is about 60°.

Arrow 254 in FIG. 9B shows the flow path of liquid as it flows down the inner surface 256 of the hollow member 236 towards the end 238 of the hollow member 236. As the liquid runs down the inner surface 256 of the hollow member, the narrow end of the hollow member reduces the capillary flow of liquid along the end surface of the hollow member 236. As a result, liquid cannot capillary flow along the underside of the hollow member 236 and the second end member 116 (not shown in FIG. 9B for clarity). Accordingly, a liquid droplet more easily forms at the end 238 of the hollow member 238 where the wall thickness is narrowest. The gravitational force exerted on the liquid droplets may therefore overcome the surface tension of the liquid such that it drips from the end 238 of the hollow member. The reduced wall thickness of the end portion 248 can mean that an air gap 258 is formed between the end portion 248 of the hollow member 236 and the second end member 116. The liquid at the end 238 of the hollow member 236 cannot capillary flow across the air gap 258, so the volume of liquid builds up until a droplet drips from the end 238 of the hollow member 236.

As shown most clearly in FIG. 9B, the door 140 may comprise a recess 172 positioned adjacent the end 238 of the hollow member 236 when the door is in the first position (i.e. the closed position of FIG. 9B). The liquid can therefore drip into the recess 172. In the example of FIG. 9B, an absorbent material 260 is arranged in the recess to absorb the liquid to stop the liquid from passing through one or more air inlets 160 (shown in FIG. 6B).

The end portion 248 has a length dimension 262 measured in a direction parallel to the longitudinal axis 200. In this example, the length dimension is about 3 mm.

The hollow member 236 has an inner diameter that narrows towards the end 238 of the hollow member 236. The inner diameter is measured in a direction perpendicular to the longitudinal axis 200. FIG. 9A shows that the inner diameter 264 at the end 238 of the hollow member 236 is smaller than the inner diameter 268 at a point closer towards the first opening 104. The hollow member 236 therefore has a tapered inner surface 256. As mentioned, this can increase the length of time taken for the liquid to flow towards the end 238 of the hollow member. In this example, an angle 270 of about 1 degree is subtended between the inner surface 256 of the hollow member and the longitudinal axis 200.

In some examples, the hollow member 236 has an inner surface 256 comprising one or more ridges or grooves (not shown) to increase the time taken for the liquid to flow towards the end 238 of the hollow member.

Figure 10A:
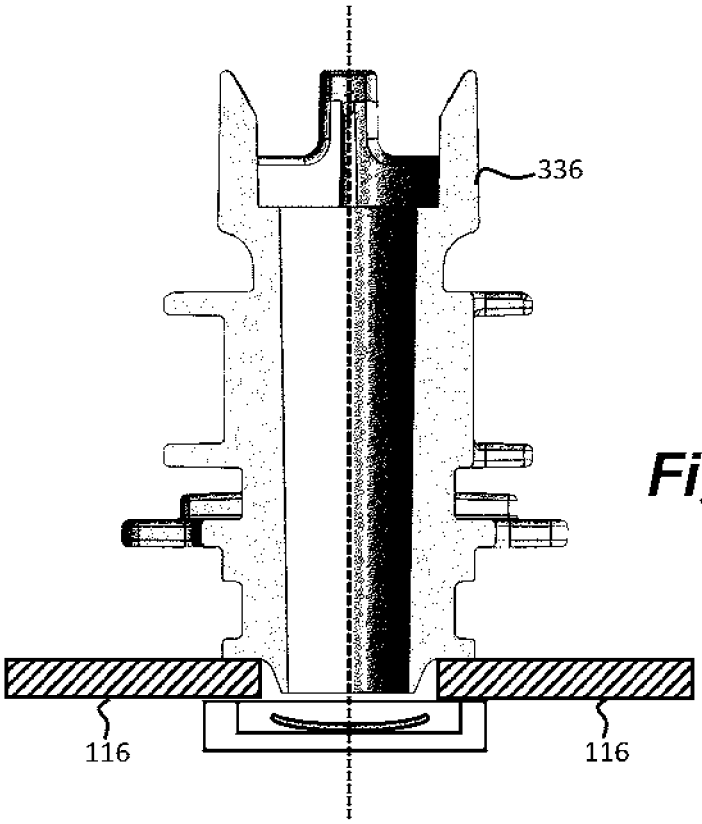
FIGS. 10A and 10B show cross-sectional views of a second example hollow member that is configured to encourage the formation of liquid droplets.
Figure 10B:
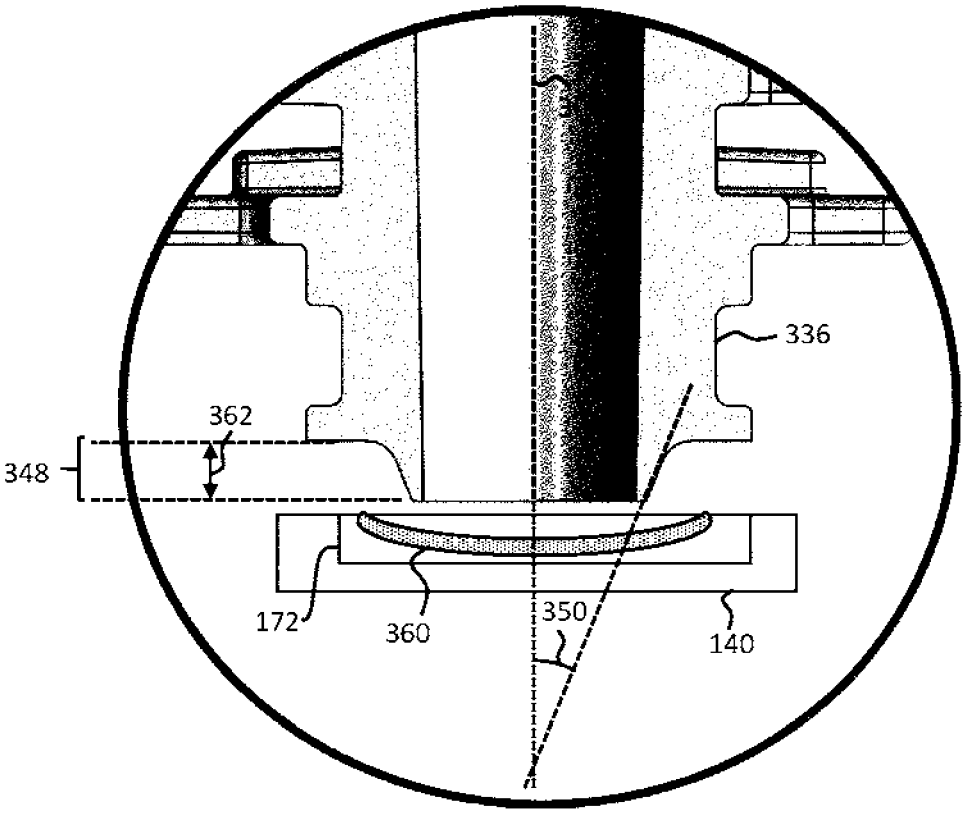

FIGS. 10A and 10B depict a cross-sectional view of another modified hollow member 336 that is adapted to reduce capillary flow within the device 100. FIG. 10B is a close-up view of a portion of FIG. 10A. The hollow member 336 may be used in the device 100 in place of the hollow member 136 depicted in FIG. 8.

The hollow member 336 of FIGS. 10A and 10B differs from that depicted in FIGS. 9A and 9B in that it has a smaller slant angle 350. In this example, the slant angle is about 25°. In addition, the end portion 348 has a longer length dimension 362. In this example, the length dimension 362 is about 5 mm.

FIGS. 10A and 10B also depict a hydrophobic layer 360 located within the recess 172 of the door 140. The liquid can run onto the hydrophobic layer 360 and remain there until a user opens the door 140 to pour off the liquid.

Figure 11:
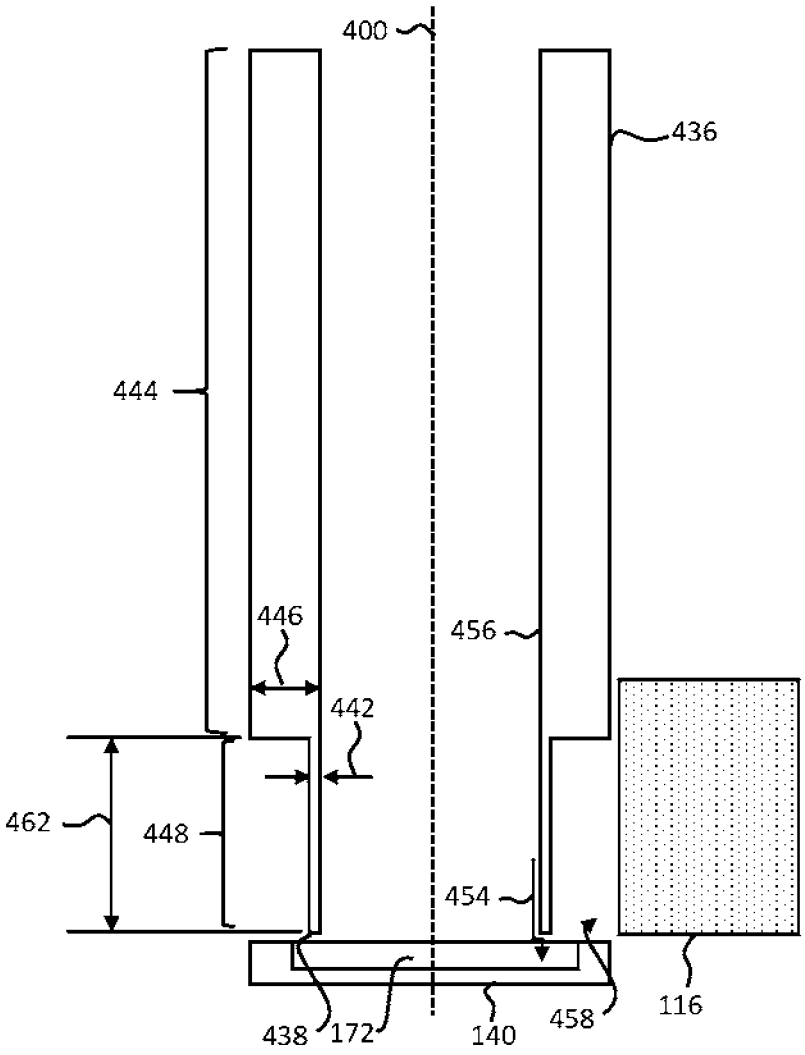
FIG. 11 is a diagrammatic representation of a cross-sectional view of a third example hollow member that is configured to encourage the formation of liquid droplets.

FIG. 11 is a diagrammatic representation of a cross-sectional view of a modified hollow member 436 that is adapted to reduce capillary flow within the device 100. The hollow member 436 may be used in the device 100 in place of the hollow member 136 depicted in FIG. 8.

The hollow member 436 has a narrow wall thickness at the end 438 the hollow member 436. The wall thickness of the hollow member 436 is measured in a direction perpendicular to a longitudinal axis 400 defined by the hollow member 436. Thus, rather than having a flat rim or flange (as in FIG. 7), the hollow member 436 has a thin or "sharp" end 438 to reduce the likelihood of capillary flow around the end of the hollow member 436.

The end 438 of the hollow member 436 positioned adjacent the second opening has a first wall thickness 442, and a portion 444 of the hollow member 436 arranged closer to the first end of the housing has a second wall thickness 446. To provide the sharp edge, the first wall thickness 442 is smaller than the second wall thickness 446. In this example, the narrowest wall thickness of the entire hollow member 436 is the first wall thickness 442. The portion 444 is located directly adjacent an end portion 448, where the end portion 448 extends away from the end 438 of the hollow member 436 and has a wall thickness that is less than the second wall thickness 446. Unlike the examples of FIGS. 9A, 9B, 10A, and 10B, the end portion 448 has wall thickness that is constant/uniform and the end portion forms a step in the outer surface at the transition between the two wall thicknesses. In other examples, a step may be formed in the inner surface at the transition between the two wall thicknesses.

Arrow 454 shows the flow path of liquid as it flows down the inner surface 456 of the hollow member 436 towards the end 438 of the hollow member 436. As the liquid runs down the inner surface 456 of the hollow member, the narrow end of the hollow member reduces the capillary flow of liquid along the end surface of the hollow member 436. As a result, liquid cannot capillary flow along the underside of the hollow member 436 and the second end member 116. Accordingly, a liquid droplet more easily forms at the end 438 of the hollow member 436 where the wall thickness is narrowest. The gravitational force exerted on the liquid droplets may therefore overcome the surface tension of the liquid such that it drips from the end 438 of the hollow member. The reduced wall thickness of the end portion 448 can mean that an air gap 458 is formed between the end portion 448 of the hollow member 436 and the second end member 116. The liquid at the end 438 of the hollow member 436 cannot capillary flow across the air gap 458, so the volume of liquid builds up until a droplet drips from the end 438 of the hollow member 438.

As previously mentioned, the door 140 may comprise a recess 172 positioned adjacent the end 438 of the hollow member 436 when the door is in the first position (i.e. the closed position of FIG. 11). The liquid can therefore drip into the recess 172. In the example of FIG. 11, the recess is empty. It may however comprise an absorbent material and/or a hydrophobic layer as discussed above with reference to FIGS. 9 and 10.

The end portion 448 has a length dimension 462 measured in a direction parallel to the longitudinal axis 400. In this example, the length dimension is about 1 mm.

The hollow member 436 of this example has an inner diameter that is constant/uniform throughout the hollow member 436. In other examples, the inner diameter may narrow towards the end 438 of the hollow member 436.

Figure 13:
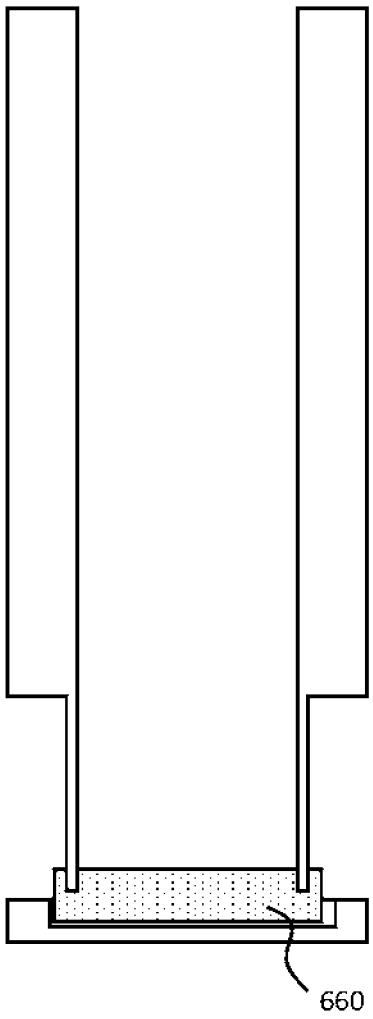
FIG. 13 is a diagrammatic representation of the example of FIG. 11 in combination with an absorbent material.

FIG. 13 depicts a further example which is the same as described above with reference to FIG. 11 apart from the addition of an absorbent material 660 positioned in the recess of the door. The absorbent material has a thickness greater than the distance between the end of the hollow member and the bottom of the recess. This may further reduce capillary flow by a wicking action provided by the absorbent material 660. For example, the end of the hollow member may be between 1 mm and 5 mm from the bottom of the recess, or between 1 mm and 3 mm from the bottom of the recess.

In the example of FIG. 13, the flow path is through the absorbent material 660, unlike in the example of FIG. 9B, where the flow path is around the absorbent material 260.

It will be appreciated that the absorbent material configuration of FIG. 13 is not limited to end profiles according to FIG. 11 but can be applied to any of the other end profiles described herein.

Figure 12:
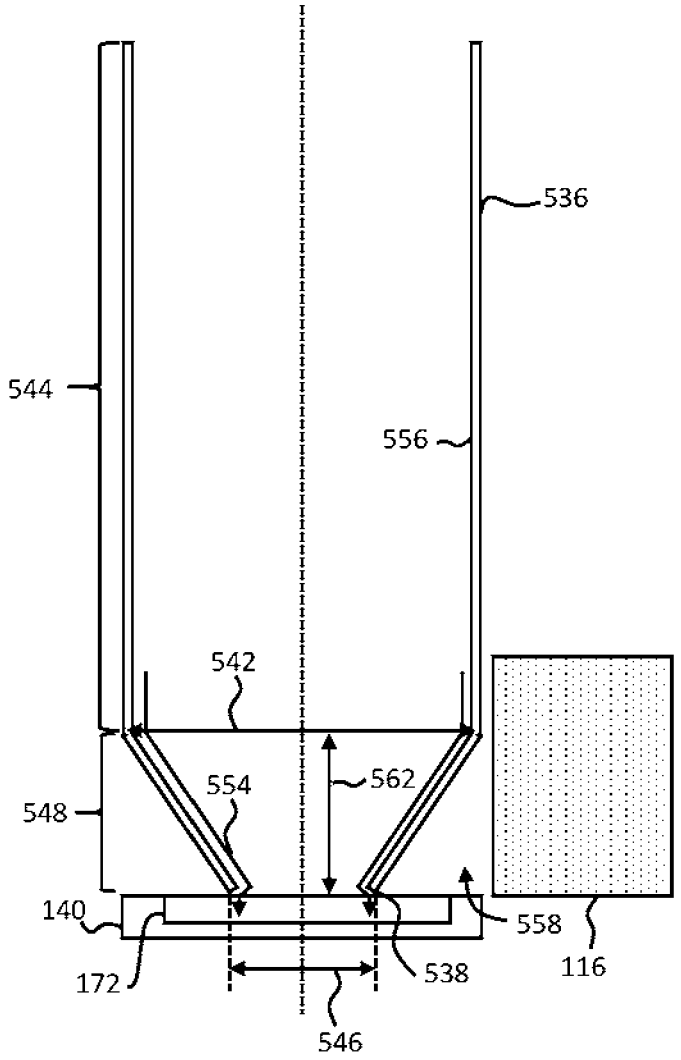
FIG. 12 is a diagrammatic representation of a cross-sectional view of a fourth example hollow member that is configured to encourage the formation of liquid droplets.

FIG. 12 is a diagrammatic representation of a cross-sectional view of a modified hollow member 536 that is adapted to reduce capillary flow within the device 100. The hollow member 536 may be used in the device 100 in place of the hollow member 136 depicted in FIG. 8.

Unlike the examples of FIGS. 9A, 9B, 10A, 10B and 11, the hollow member 536 of this example has a uniform wall thickness along the length of the hollow member 536. The wall thickness of the hollow member 536 is measured in a direction perpendicular to a longitudinal axis 500 defined by the hollow member 536. Instead of having an end portion with a reduced wall thickness, the hollow member has an end portion with a reduced width dimension (where the width dimension is measured in a direction perpendicular to the longitudinal axis 500). As in previous examples, this can reduce the likelihood of capillary flow around the end of the hollow member 536.

The hollow member has an end portion 548 having a width dimension that narrows towards the end 538 of the hollow member 536. For example, the end portion 548 has a first width dimension 542 where the end portion 548 meets another portion 544 located closer to the first end of the housing than the end 538 of the hollow member, and the end portion 548 has a second narrower width dimension 546 at the end 538 of the hollow member 536. In some examples, the other portion 544 has a width dimension that is substantially constant. The end portion 548 is located at the end 538 of the hollow member 536 and is the region having a reduced width dimension.

The reduced width of the end portion 548 can provide an air gap 558 between the end portion 548 of the hollow member and other components within the device. Arrow 554 shows the flow path of liquid as it flows down the inner surface 556 of the hollow member 536 towards the end 538 of the hollow member 536. The liquid at the end of the hollow member cannot cross the air gap 558, and the volume of liquid builds up until a droplet drips from the end the hollow member.

As previously mentioned, the door 140 may comprise a recess 172 positioned adjacent the end 538 of the hollow member 536 when the door is in the first position (i.e. the closed position of FIG. 11). The liquid can therefore drip into the recess 172. In the example of FIG. 12, the recess is empty. It may however comprise an absorbent material and/or a hydrophobic layer as described above with reference to FIGS. 9 and 10.

The end portion 548 has a length dimension 562 measured in a direction parallel to the longitudinal axis 500. In this example, the length dimension is about 2 mm.

The hollow member 536 of this example has an inner diameter that is narrower towards the end 538 of the hollow member 536.

As mentioned, in the example of FIG. 12, the hollow member has a width dimension that narrows towards the end of the hollow member. It should be noted that the examples depicted in FIGS. 9A, 9B, 10A, 10B and 11 also have a hollow member with a width dimension that is narrower towards the end of the hollow member.

In a variation of FIG. 12, an end portion may have a width dimension which is wider towards the end of the hollow member. In other words, rather than tapering towards the end, the end portion may be flared or otherwise enlarged. This can also encourage the formation of droplets when the wall thickness of the end portion is substantially constant.

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An aerosol provision device, comprising:

a housing delimiting a first opening at a first end of the housing, through which to receive aerosol generating material, and delimiting a second opening at a second end of the housing; and at least one heater arranged within the housing and configured to heat the aerosol generating material received within the housing thereby to generate an aerosol; and a hollow member arranged within the housing and extending at least partially between the second and first openings, wherein:

the hollow member has an end that faces the second opening and is configured to discourage capillary flow around the end, and wherein:

the hollow member defines an axis;

an outer wall of the hollow member at the end of the hollow member has a first wall thickness measured in a direction perpendicular to the axis;

a part of the hollow member arranged closer to the first end of the housing than the end of the hollow member has a second wall thickness measured in a direction perpendicular to the axis; and the first wall thickness is smaller than the second wall thickness.

2. The aerosol provision device of claim 1, wherein the end that faces the second opening is configured to encourage the formation of liquid droplets.

3. The aerosol provision device of claim 1, wherein an end portion of the hollow member has a wall thickness that tapers from the second wall thickness to the first wall thickness.

4. The aerosol provision device of claim 1, wherein the end portion is a hollow frustum, and a slant angle of the frustum is less than about 70°.

5. The aerosol provision device of claim 3, wherein the end portion has a length dimension measured in a direction parallel to the axis, and wherein the length dimension is between about 0.5 mm and about 5 mm.

6. The aerosol provision device of claim 1, wherein the first wall thickness is less than about 0.5 mm.

7. The aerosol provision device of claim 1, wherein the first wall thickness is less than about 50% of the second wall thickness.

8. The aerosol provision device of claim 1, wherein:

the hollow member defines an axis; and the hollow member comprises:

an end portion positioned adjacent the second opening and having a width dimension in a direction perpendicular to the axis, that reduces towards the end.

9. The aerosol provision device of claim 8, wherein the end portion is a hollow frustum.

10. The aerosol provision device of claim 1, comprising an absorbent material arranged to receive the liquid from the end of the hollow member.

11. The aerosol provision device of claim 10, wherein at least a portion of the hollow member is hydrophobic, or comprises a hydrophobic coating, to encourage the liquid to flow towards the absorbent material.

12. The aerosol provision device of claim 1, wherein the device comprises a cover movable between a first position in which the second opening is blocked by the cover and a second position in which the second opening is not blocked, the cover comprising a recess positioned adjacent the second opening when the cover is in the first position to receive the liquid from the end of the hollow member.

13. The aerosol provision device of claim 12, comprising an absorbent material positioned at least partially in the recess for absorbing liquid.

14. The aerosol provision device of claim 12, comprising a hydrophobic material arranged at least partially in the recess.

15. The aerosol provision device of claim 13, wherein the absorbent material is arranged on the hydrophobic material.

16. The aerosol provision device of claim 1, wherein the hollow member has an inner diameter that reduces towards the end.

17. The aerosol provision device of claim 1, wherein the hollow member has an inner surface comprising one or more ridges or grooves configured to impede any liquid flow along the inner surface towards the second opening.

18. A system comprising:

the aerosol provision device according to claim 1; and aerosol generating material at least partially contained within the housing.

19. An aerosol provision device, comprising:

a housing delimiting a first opening at a first end of the housing through which to receive aerosol generating material and delimiting a second opening at a second end of the housing; and at least one inductive heater arranged within the housing and configured to heat the aerosol generating material received within the housing thereby to generate an aerosol; and a hollow member arranged within the housing and extending at least partially between the second and first openings, wherein:

the hollow member has:

a first end in the direction towards the first opening and a second end in the direction towards the second opening;

an inner diameter that reduces towards the second end; and a minimum inner diameter positioned less than about 50% of the distance from the second end to the first end.

* * * * *